US010662671B2

(12) United States Patent
Stallbaumer

(10) Patent No.: US 10,662,671 B2
(45) Date of Patent: May 26, 2020

(54) LOCK ASSEMBLY WITH LOCKING HANDLE

(71) Applicant: PTMW, INC., Topeka, KS (US)

(72) Inventor: John Stallbaumer, Topeka, KS (US)

(73) Assignee: PTMW, INC., Topeka, KS (US)

( * ) Notice: Subject to any disclaimer, the term of this patent is extended or adjusted under 35 U.S.C. 154(b) by 1675 days.

(21) Appl. No.: 14/097,345

(22) Filed: Dec. 5, 2013

(65) Prior Publication Data

US 2015/0159410 A1 Jun. 11, 2015

(51) Int. Cl.

| | |
|---|---|
| ***E05B 13/00*** | (2006.01) |
| ***E05B 65/10*** | (2006.01) |
| ***E05C 3/04*** | (2006.01) |
| ***E05B 15/00*** | (2006.01) |
| ***E05C 9/04*** | (2006.01) |

(52) U.S. Cl.

CPC ..... *E05B 13/004* (2013.01); *E05B 15/0086* (2013.01); *E05B 65/1006* (2013.01); *E05B 65/1066* (2013.01); *E05C 3/042* (2013.01); *E05C 9/043* (2013.01); *Y10S 292/62* (2013.01); *Y10T 292/1015* (2015.04); *Y10T 292/57* (2015.04)

(58) Field of Classification Search

CPC . E05C 9/04; E05B 3/08; E05B 13/004; E05B 65/10; E05B 15/004; Y10S 292/62

USPC ..... 292/358, 359, 92, 32–43; 70/210; 109/59 R

See application file for complete search history.

(56) References Cited

U.S. PATENT DOCUMENTS 377,815 A * 2/1888 Selleck ..... E05B 13/004 292/359
874,793 A * 12/1907 Robinson ..... E05B 65/1073 292/93
991,018 A * 5/1911 Powers ..... E05B 13/004 292/359
1,046,438 A * 12/1912 Caldwell ..... E05B 27/00 70/120
1,288,816 A * 12/1918 Bolles ..... E05B 65/1006 292/92
1,646,990 A * 10/1927 Bolles ..... 292/92

(Continued)

FOREIGN PATENT DOCUMENTS

CH 172655 A * 10/1934 ..... E05B 13/004
DE 3231069 A1 * 2/1984 ..... E05B 13/004

(Continued)

OTHER PUBLICATIONS

FR 674427 translation.*

*Primary Examiner* — Carlos Lugo
(74) *Attorney, Agent, or Firm* — Stinson LLP

(57) ABSTRACT

A lock assembly has an actuator that is moveable between first and second positions and a locking structure that is coupled to the actuator. The locking structure is positioned to engage a portion of a lock when the actuator is in the first position to prevent movement of the actuator to the second position. A latch assembly is preferably coupled to the actuator and includes a latch that is moveable between engaged and disengaged positions. Moving the actuator from the first position to the second position moves the latch to the engaged position, and moving the actuator from the first position to a third position moves the latch to a disengaged position.

22 Claims, 12 Drawing Sheets

(56) References Cited

U.S. PATENT DOCUMENTS 1,833,572 A * 11/1931 Hardesty ..... E05B 77/48 180/289
1,844,767 A * 2/1932 Kelly ..... E05B 65/1066 292/254
1,895,594 A * 1/1933 Strandt ..... E05C 9/043 70/118
1,909,697 A * 5/1933 Macbeth ..... E05B 13/004 292/150
2,108,359 A * 2/1938 Accardi ..... E05C 9/04 292/165
2,169,692 A * 8/1939 Hansen ..... E05C 9/043 292/40
2,628,117 A 2/1953 Robinson
2,729,089 A * 1/1956 Pelcin ..... E05B 47/0002 292/36
2,931,205 A 4/1960 Schmitz
3,087,323 A * 4/1963 Foster ..... E05B 65/1066 292/92
3,334,500 A * 8/1967 Bejarano ..... E05B 63/20 292/21
3,371,628 A * 3/1968 McClellan ..... E05B 65/0082 109/59 R
3,458,225 A * 7/1969 Stuteville ..... E05B 65/1066 292/92
3,563,585 A * 2/1971 Welch ..... E05B 63/20 292/234
3,843,173 A * 10/1974 Harrell ..... E05B 9/08 292/359
3,873,141 A * 3/1975 Peterson ..... E05B 65/1066 292/153
3,894,759 A * 7/1975 Balducci ..... E05B 65/1066 292/336.3
3,897,092 A * 7/1975 Atkins ..... E05B 65/1066 292/336.3
3,953,061 A * 4/1976 Hansen ..... E05C 9/002 292/34
3,993,335 A * 11/1976 Schmidt ..... E05B 63/20 292/21
4,145,900 A * 3/1979 Ohno ..... E05B 65/104 292/92
4,288,944 A * 9/1981 Donovan ..... E05C 9/042 292/39
4,480,451 A * 11/1984 Fujiya ..... E05B 65/0053 292/21
4,641,865 A * 2/1987 Pastva ..... E05B 63/0069 292/5
4,813,723 A 3/1989 Anderson et al.
4,961,330 A * 10/1990 Evans ..... E05B 47/0603 292/92
5,077,992 A 1/1992 Su
5,088,776 A * 2/1992 James ..... E05B 65/0075 109/59 R
5,088,786 A * 2/1992 Linder ..... E05B 63/20 292/336.3
5,094,483 A * 3/1992 James ..... E05B 65/0075 109/59 R
5,184,853 A * 2/1993 Whatley ..... E05B 13/002 292/205
5,245,846 A * 9/1993 James ..... E05B 65/0078 109/59 R
5,452,927 A * 9/1995 Uyeda ..... E05B 15/004 292/196
5,470,115 A 11/1995 Berg et al.
5,472,246 A 12/1995 Puric
5,715,715 A * 2/1998 Nunez ..... E05B 47/0012 292/144
5,865,050 A 2/1999 Michaud et al.
5,878,606 A 3/1999 Chaput et al.
5,934,122 A 8/1999 Edwards et al.
5,947,534 A * 9/1999 Zarzycki, Jr. ..... E05B 65/1053 292/170
6,000,733 A * 12/1999 Linder ..... E05B 65/1046 292/21
6,662,605 B2 12/2003 Molzer
6,748,776 B2 * 6/2004 Bullock ..... E05B 1/003 292/336.3
6,802,543 B1 10/2004 Wakefield
6,851,291 B2 * 2/2005 Nunez ..... E05B 47/0673 70/150
7,343,762 B1 * 3/2008 East ..... E05B 13/108 292/36
7,946,080 B2 5/2011 Ellerton et al.
8,347,665 B2 * 1/2013 Rasmussen ..... E05B 47/0673 109/59 R
8,449,003 B2 * 5/2013 Bunker, II ..... E05B 3/10 292/1
8,555,685 B2 * 10/2013 Frolov ..... E05B 47/0673 292/137
8,807,609 B2 * 8/2014 Stallbaumer ..... E05B 67/36 292/1
2005/0081581 A1 * 4/2005 Caldwell ..... E05B 17/2023 70/210
2006/0185409 A1 8/2006 Sun et al.
2013/0264834 A1 10/2013 Stallbaumer
2014/0182489 A1 * 7/2014 Suggs ..... E05G 1/04 109/59 R

FOREIGN PATENT DOCUMENTS

DE 3701440 A1 * 7/1988 ..... E05B 47/0038
EP 0 661 409 2/2000
EP 2278098 * 1/2011
EP 2 327 849 6/2011
FR 674427 A * 1/1930 ..... E05C 9/042
FR 1263406 A * 6/1961 ..... E05B 13/004
FR 1397351 A * 4/1965 ..... E05B 13/004
FR 3004207 A1 * 10/2014 ..... E05B 15/004
FR 3028547 A1 * 5/2016 ..... E05C 9/042
GB 276634 5/1928
GB 1 563 393 3/1980
GB 2 300 447 11/1996
WO WO 99/60233 11/1999
WO WO 2012/149033 11/2012

* cited by examiner

LOCK ASSEMBLY WITH LOCKING HANDLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed toward a lock assembly for a door, and in particular to a lock assembly having a locking handle.

2. Description of Related Art

A variety of door locking systems exist, including three point locking systems. Three point locking systems typically have three dual action bolts that extend from a door into a door frame at different locations, such as at the side, top and bottom of the door.

One type of three point locking system has a handle that moves from a neutral position in one direction to extend the bolts into the door frame thereby securing the door to the frame. When the handle is released, it returns to the neutral position and the bolts remain extended into the frame. Moving the handle in the opposite direction retracts the bolts from the door frame thereby allowing the door to be opened. The bolts are operable to secure the door to the frame, but do not prevent unauthorized entry into the enclosure to which the door provides access.

In order to prevent unauthorized entry, it is known to provide a tab on the handle with an opening that aligns with an opening on a bracket extending from the door. When the bolts are extended into the door frame, a padlock is inserted into the aligned openings to prevent rotation of the handle in the direction that retracts the bolts. While this system is generally effective, a determined vandal may cut the handle above the padlock and gain entry to the enclosure by rotating the portion of the handle that was cut away from the padlock.

Another system for preventing unauthorized entry includes a removable handle and a puck lock, as described in U.S. Patent Application Publication No. 2013/0264834. When the bolts are extended into the door frame, the handle is removed and a vandal-resistant puck lock is secured over a portion of an actuator that is operable to engage the handle. While this type of system is more vandal-resistant than the padlock system described above, the handle and puck lock may be misplaced when not in use.

BRIEF SUMMARY OF THE INVENTION

A lock assembly in accordance with the present invention includes an actuator that is moveable between at least first and second positions, and a locking structure coupled to the actuator that is configured to engage a portion of a lock when the actuator is in the first position so as to prevent movement of the actuator. In a preferred embodiment, the locking structure is configured to receive a portion of a lock when the actuator is in the first position so as to prevent movement of the actuator. The actuator preferably includes a handle that, even if cut by vandals, is not rotatable when the lock engages the locking structure. The lock is preferably separate from the actuator and locking structure so that it may be installed and/or replaced by an owner of the lock assembly separate from the remainder of the assembly.

In one embodiment, a latch assembly is also coupled to the actuator and includes at least one latch that is moveable between an engaged position and a disengaged position. The actuator moves from the first position to the second position to engage the latch, and the actuator moves in the opposite direction from the first position to a third position to disengage the latch. Once the actuator has engaged or disengaged the latch, it will return to the first position with the latch remaining in the engaged or disengaged position respectively. The locking structure is positioned to engage a portion of a lock when the actuator is in the first position. Thus, in order to lock a door, for example, the actuator may first be moved to the second position to engage the latch within the door frame, and then, upon returning to the first position, a portion of the lock may be extended into a receptacle of the locking structure thereby securing the door in the latched position.

In another embodiment, an emergency release is preferably coupled to the latch assembly and is operable to move the latch from the engaged position to the disengaged position even when the lock engages the locking structure. This allows a person inside an enclosure with a door utilizing the lock assembly to exit the enclosure even if the door has been locked from the outside utilizing the lock assembly.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
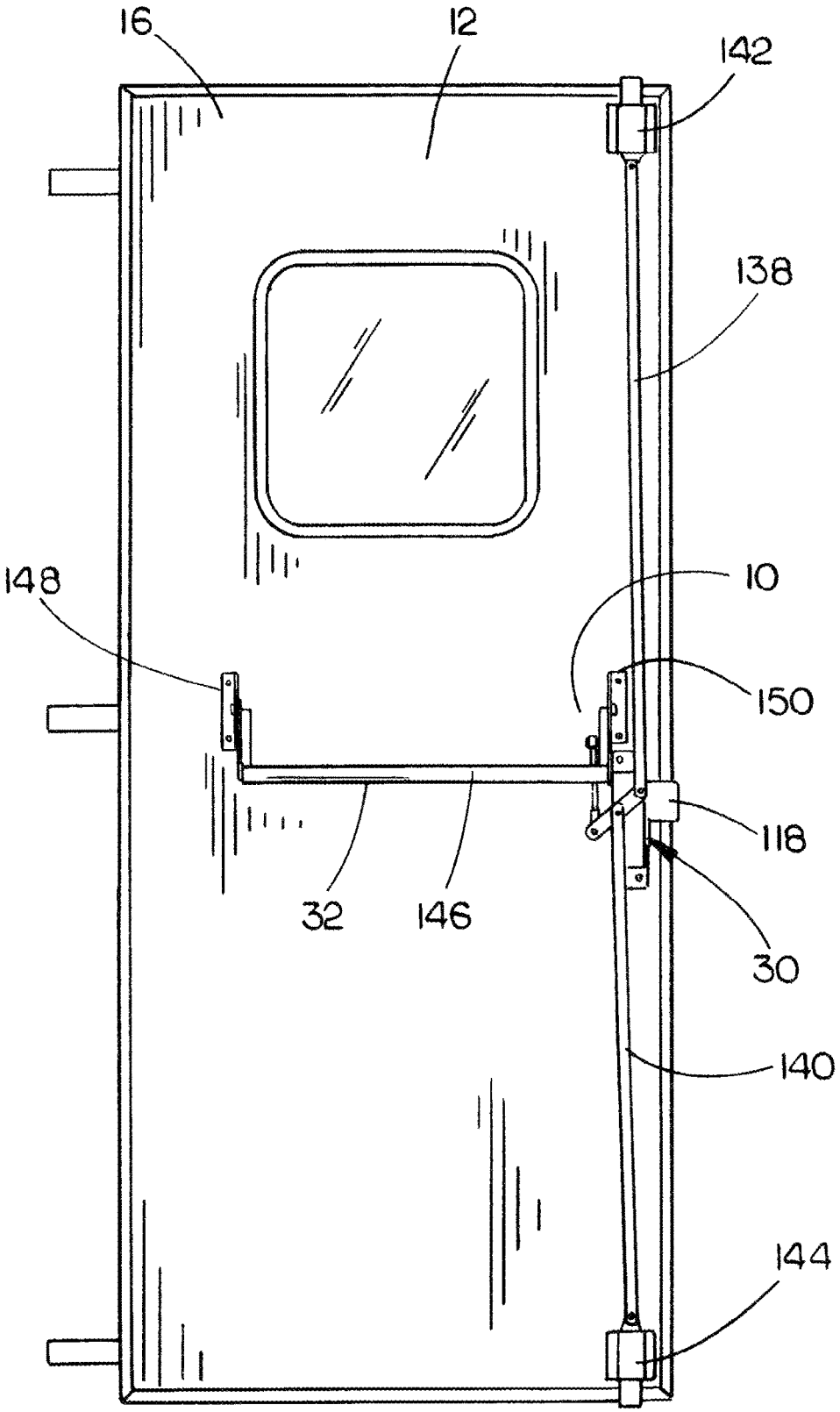
FIG. 1 is a rear elevational view of a door to which is mounted a lock assembly in accordance with the present invention.
Figure 5:
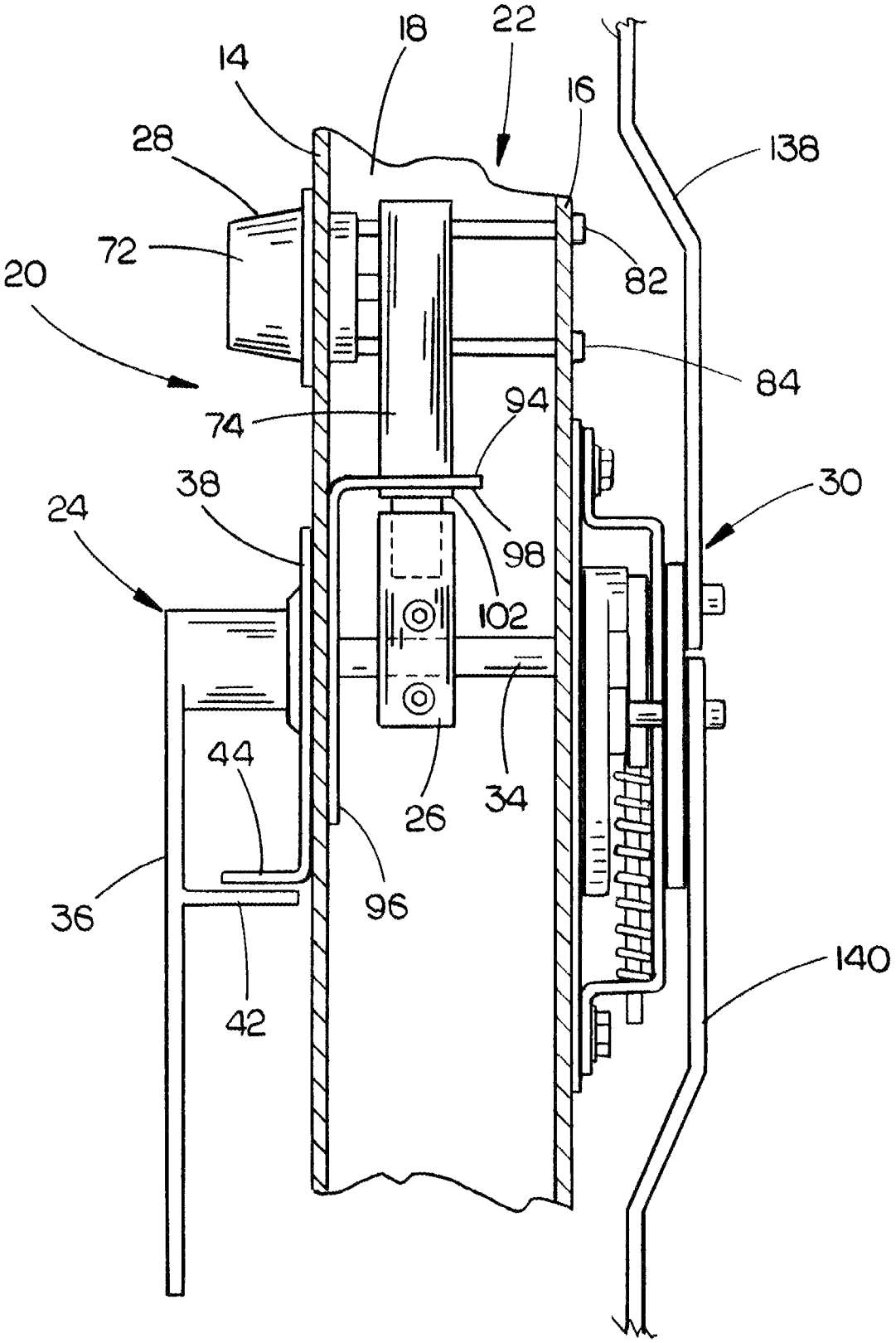
FIG. 5 is a cross-sectional view showing the lock assembly mounted to the door.

A lock assembly in accordance with the present invention is shown generally in FIG. 1 as 10. Lock assembly 10 is mounted to a door 12 and is operable to lock door 12 in place within a door frame (not shown). As shown in FIG. 5, door 12 includes an outer wall 14 and an inner wall 16 with a cavity 18 between the walls 14 and 16. An exterior side 20 of door 12 is on one side of outer wall 14 and an interior side 22 is on the opposite side of outer wall 14.

Referring to FIG. 5, lock assembly 10 includes an actuator 24, a locking structure 26, a lock 28, a latch assembly 30, and an emergency release 32 (FIG. 1).

Actuator 24 includes a shaft 34 and a handle 36 that is joined with the shaft 34 such that the handle 36 and shaft 34 rotate together. Shaft 34 extends through an opening (not shown) in outer wall 14 and an opening (not shown) in inner wall 16. A mounting plate 38 is mounted to the exterior side 20 of outer wall 14 with fasteners, one of which is identified as 40 in FIG. 4. Handle 36 is rotatably coupled with mounting plate 38, and shaft 34 extends through an opening (not shown) in mounting plate 38. Handle 36 includes a locking tab 42 that is positioned below a locking tab 44 of mounting plate 38 when the handle 36 is in a generally vertical position. Locking tab 44 has an opening 46 that aligns with an opening (not shown) in locking tab 42 when handle 36 is in a generally vertical position. The aligned openings 46 may receive a padlock (not shown) to secure handle 36 to mounting plate 38 and thereby prevent rotation of handle 36 and shaft 34.

Figure 8:
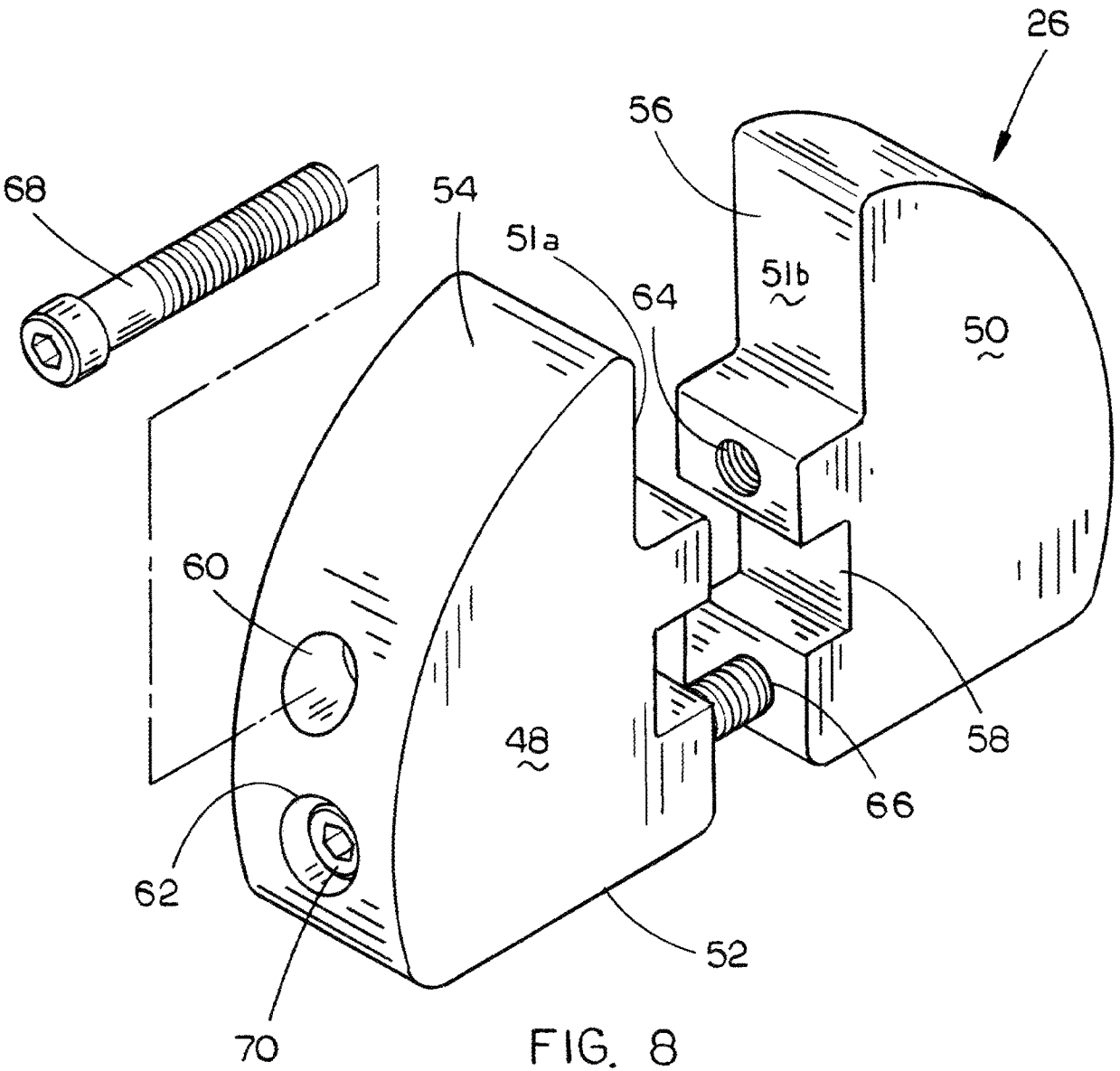
FIG. 8 is a partially exploded view of the locking structure.
Figure 9:
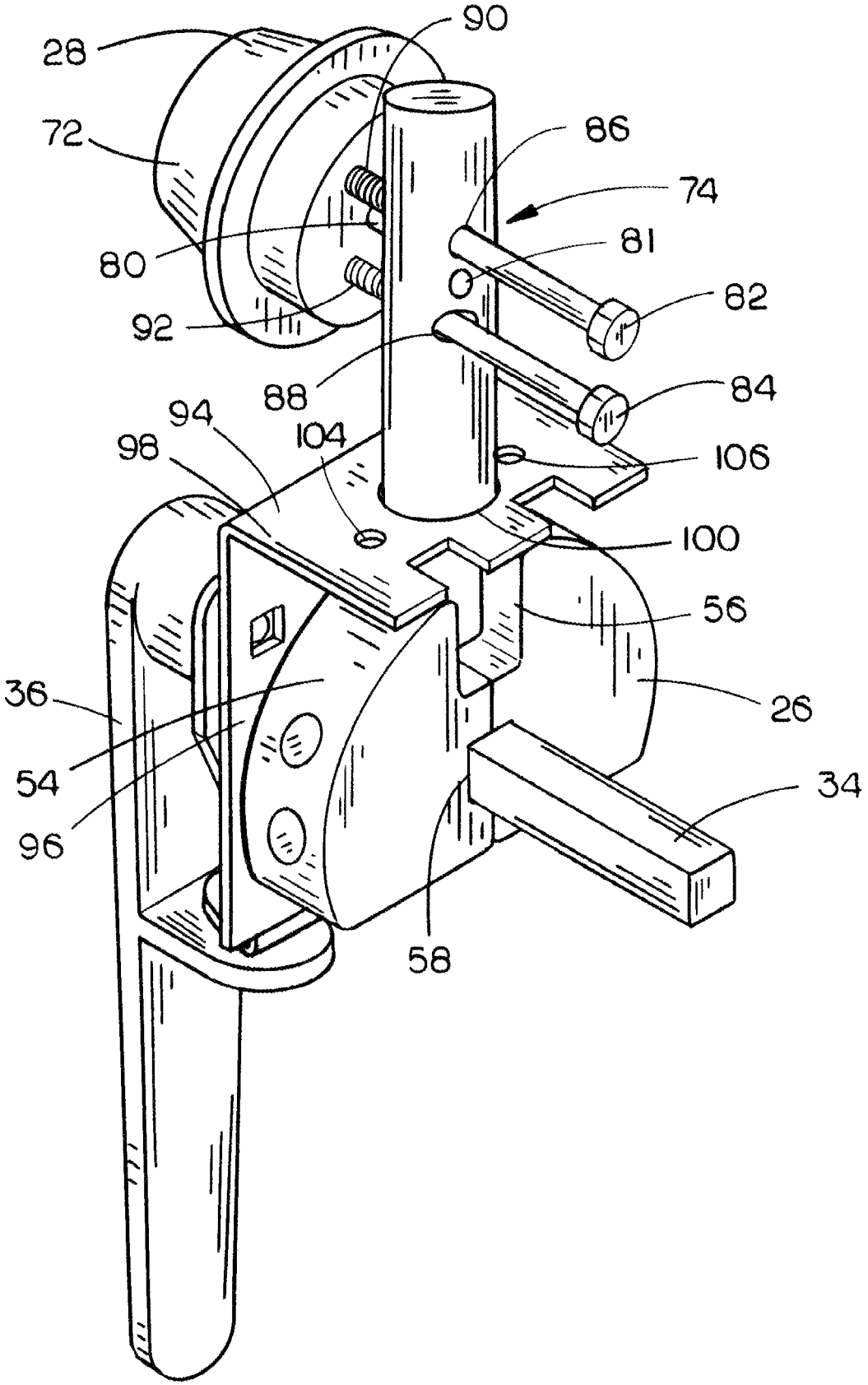
FIG. 9 is a perspective view of the actuator, the locking structure, and the lock.

As shown in FIG. 5, locking structure 26 is removably coupled to shaft 34 adjacent the interior side 22 of outer wall 14. Locking structure 26 is positioned inside of cavity 18. Referring to FIG. 8, locking structure 26 includes halves 48 and 50, which are substantially mirror images of each other. Halves 48 and 50 are each formed in the general shape of a quarter of a circle and are joined together in abutting engagement along inner walls 51*a* and 51*b* to define a structure with a relatively flat base 52 and a semi-circular sidewall 54. Notches formed in the inner walls 51*a* and 51*b* define a central open topped rectangular-shaped receptacle 56 positioned along the top of side wall 54 and a central closed square-shaped opening 58 positioned a distance below receptacle 56 when halves 48 and 50 are joined. Opening 58 is sized to snugly receive shaft 34, as shown in FIG. 9. A portion of receptacle 56 and a portion of opening 58 is formed in each of halves 48 and 50. Half 48 includes countersunk holes 60 and 62 that are aligned with threaded holes 64 and 66, respectively, in half 50. A bolt 68 is received by holes 60 and 64, and a bolt 70 is received by holes 62 and 66 to secure locking structure 26 to shaft 34. As shown in FIG. 9, locking structure 26 is joined to shaft 34 so that receptacle 56 is at the top of locking structure 26 when handle 36 is in a generally vertical position.

Figure 4:
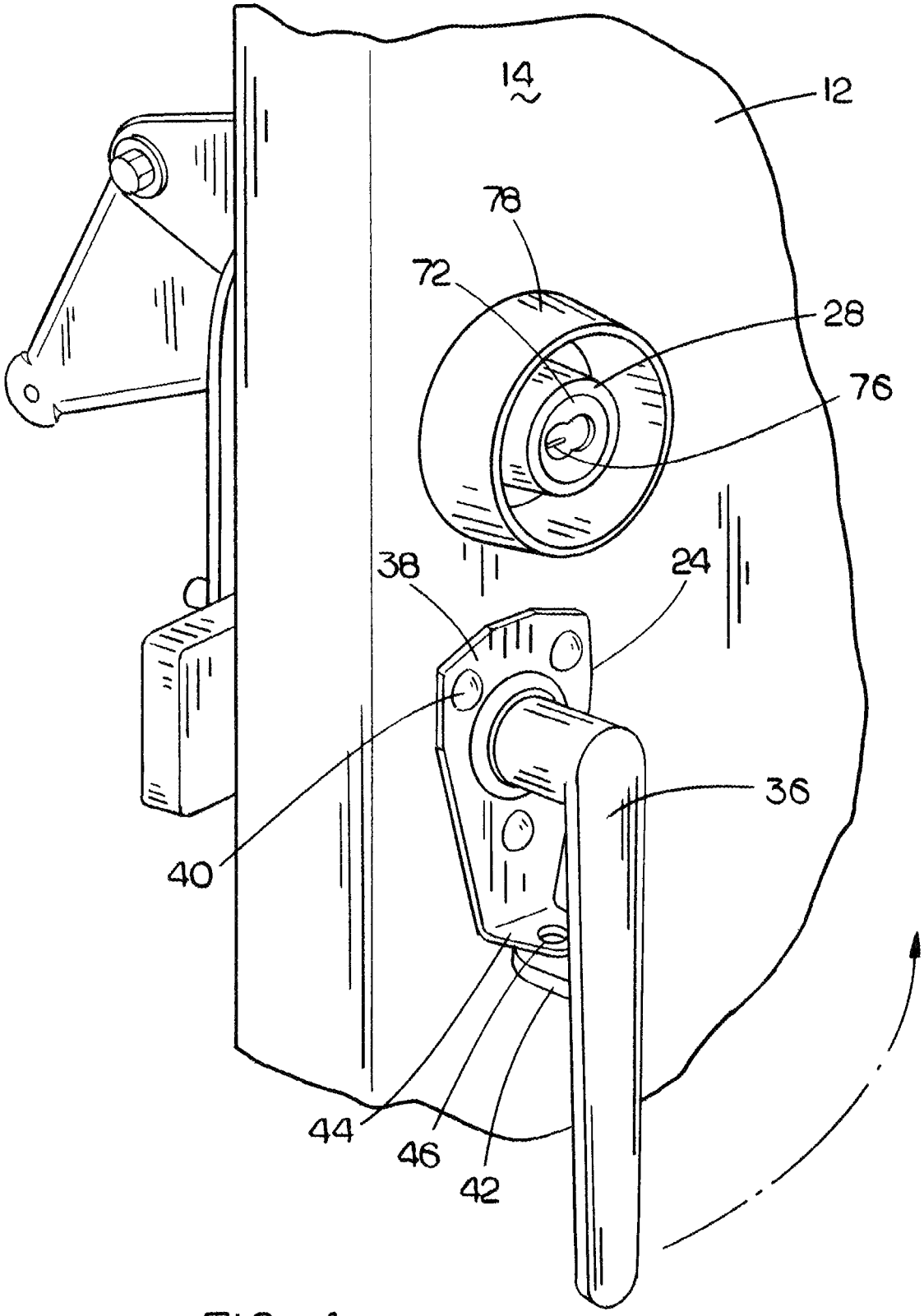
FIG. 4 is a perspective view of a portion of an actuator and a lock of the lock assembly mounted to an outer wall of the door.

Referring to FIG. 5, lock 28 is mounted to door 12 above actuator 24 and locking structure 26. Lock 28 is a conventional deadbolt with a cylinder 72 extending outward from exterior side 20 of outer wall 14 and a deadbolt assembly 74 positioned within cavity 18. As shown in FIG. 4, cylinder 72 includes an opening 76 configured to receive a key (not shown). A protective shroud 78 extends outward from outer wall 14 and surrounds cylinder 72 to protect lock 28.

As shown in FIG. 9, a spindle 80 extends from cylinder 72 through a slotted opening 81 in deadbolt assembly 74. Mounting bolts 82 and 84 secure lock 28 to door 12. Referring to FIG. 5, mounting bolts 82 and 84 extend through openings (not shown) in inner wall 16. Referring to FIG. 9, mounting bolts 82 and 84 extend through openings 86 and 88, respectively, in deadbolt assembly 74 and are received by threaded openings 90 and 92, respectively, in cylinder 72. As shown in FIG. 5, an L-shaped bracket 94 is mounted to the interior side 22 of outer wall 14 with the same fasteners 40 (FIG. 4) that mount actuator 24 to door 12. Bracket 94 includes a vertical portion 96 mounted to outer wall 14 and a horizontal portion 98 extending outward from outer wall 14. Horizontal portion 98 includes a central opening 100, shown in FIG. 9, that receives a portion of deadbolt assembly 74. A faceplate 102 (FIG. 5) of deadbolt assembly 74 is positioned below horizontal portion 98 and is mounted to it with screws (not shown) received by threaded openings 104 and 106 (FIG. 9).

Figure 10:
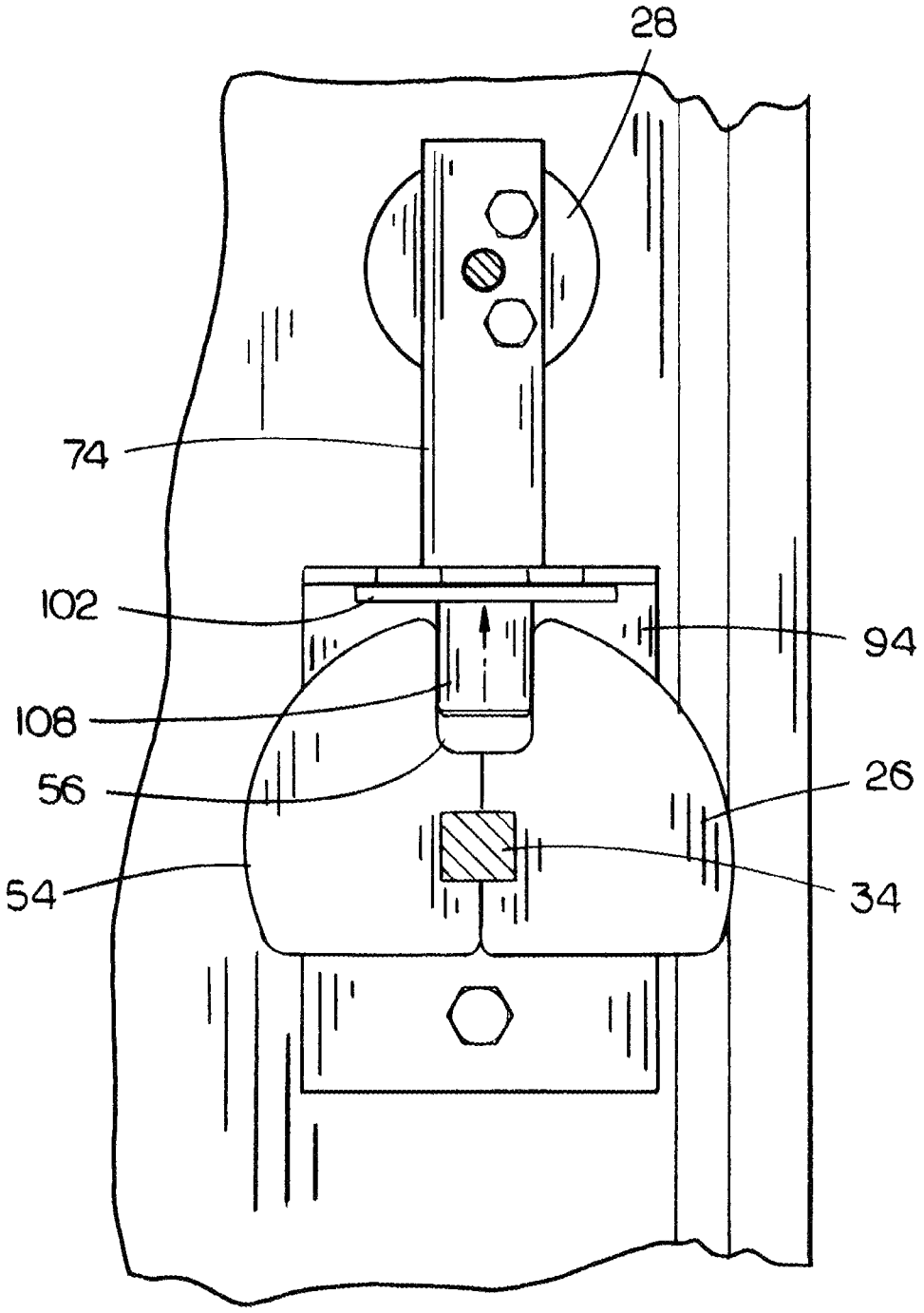
FIG. 10 is a close-up view showing a portion of the lock engaging the locking structure.

Referring to FIG. 10, deadbolt assembly 74 includes a bolt 108 that moves vertically downward away from faceplate 102 when actuated. Bolt 108 is positioned adjacent the interior side 22 of door 12. Spindle 80 (FIG. 9) rotates with rotation of an appropriate key inserted in opening 76 (FIG. 4) to extend bolt 108 to a locked position or retract bolt 108 to an unlocked position. When handle 36 is in a generally vertical position, receptacle 56 of locking structure 26 is positioned to receive bolt 108 when bolt 108 is in its locked position. When bolt 108 is received by receptacle 56, handle 36 cannot be rotated. The side wall 54 of locking structure 26 prevents actuation of bolt 108 to its locked position when handle 36 is rotated in either direction from its generally vertical position shown in FIG. 9. Lock 28 is separate from door 12, actuator 24, locking structure 26, latch assembly 30 and emergency release 32, and may be replaced or installed separately from door 12, actuator 24, locking structure 26, latch assembly 30 and emergency release 32.

Although lock 28 is shown in the drawings and described above as a typical deadbolt, lock 28 may comprise any type of lock having a protrusion that is capable of being received by receptacle 56 and a user input device that is operable to move the protrusion between locked and unlocked positions. For example, the lock 28 may comprise a user input device that is a key card reader mounted to the exterior side 20 of door 12 and a lock protrusion that is a solenoid actuated bolt electrically coupled to the key card reader. Further, the locking structure 26 and lock 28 may alternatively be configured to include engaging portions other than receptacle 56 and bolt 108 that are operable to engage each other when the lock 28 is in the locked position to prevent rotation of handle 36.

Figure 2:
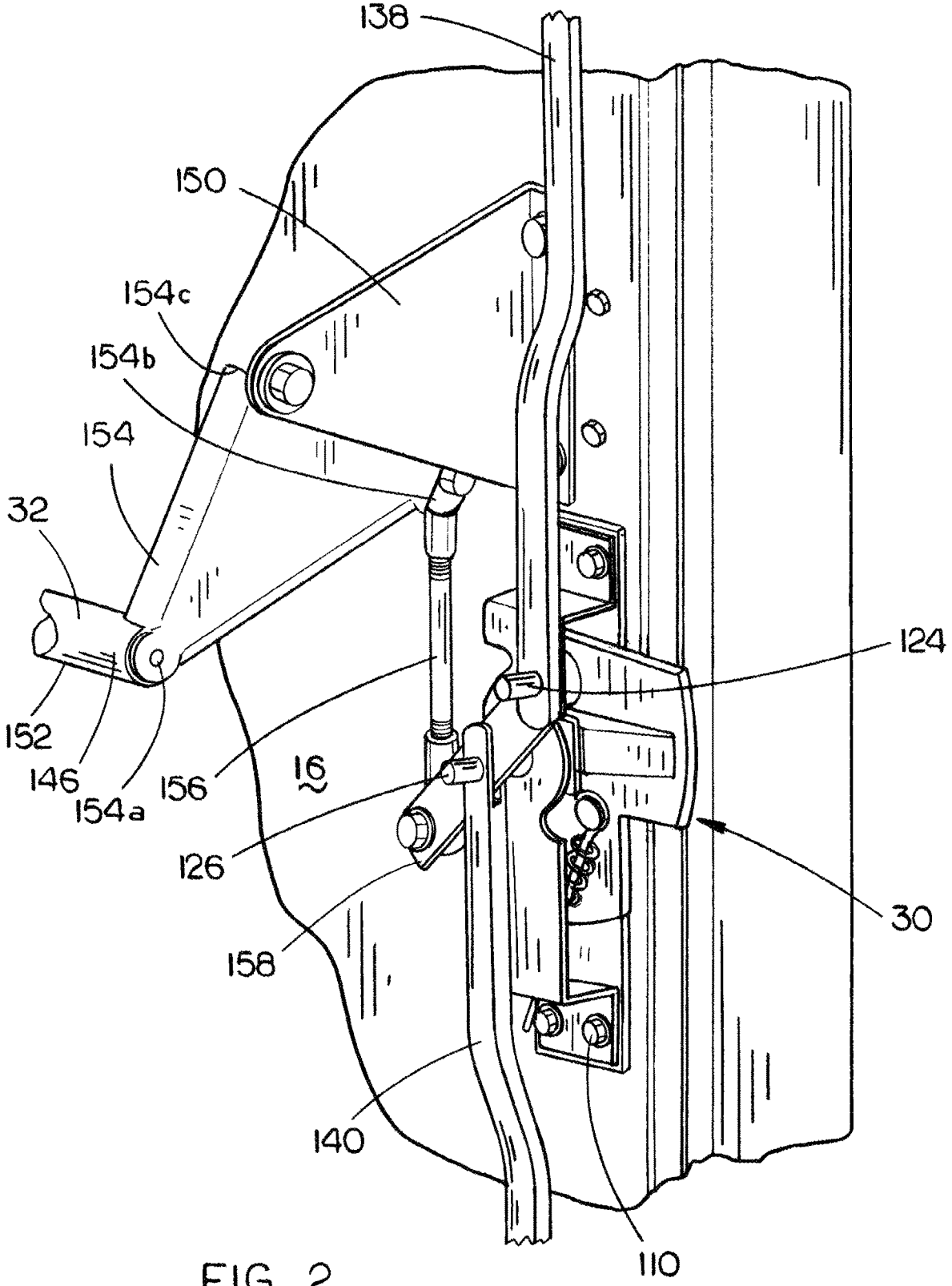
FIG. 2 is a perspective view of portions of a latch assembly and an emergency release of the lock assembly mounted to an inner wall of the door.
Figure 6:
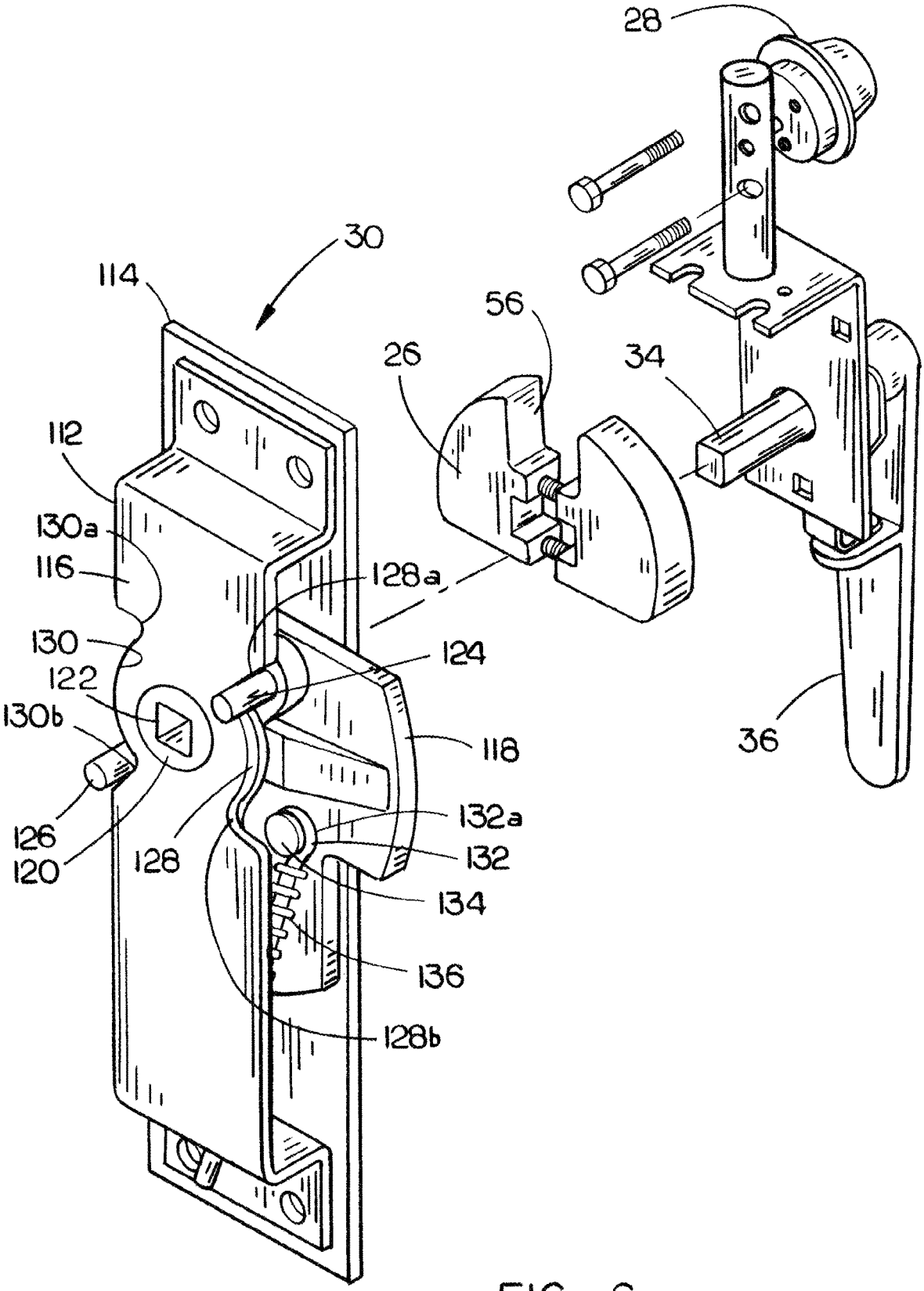
FIG. 6 is a partially exploded view of the actuator, the lock, a locking structure, and a portion of the latch assembly showing the latch in the engaged position.
Figure 7:
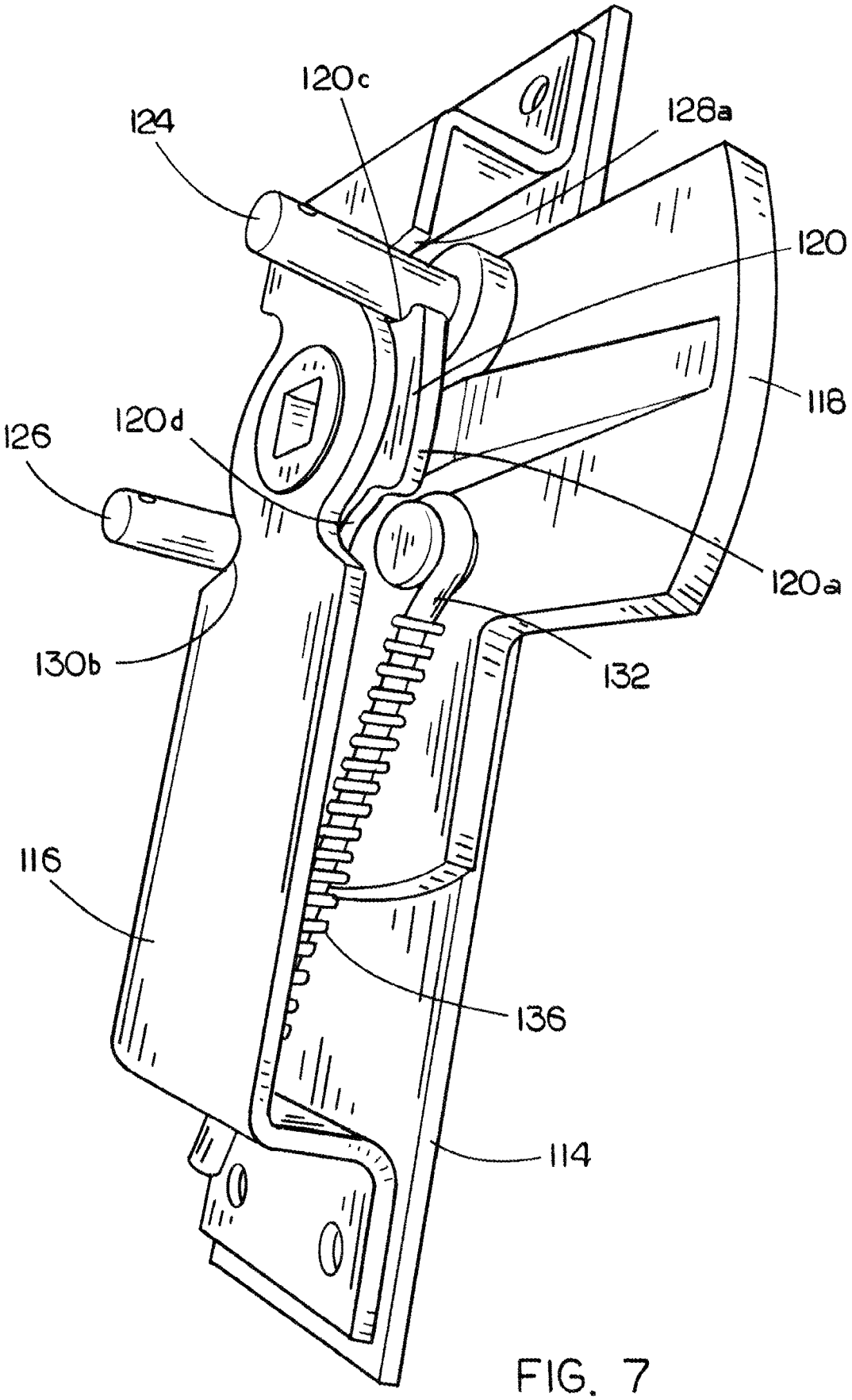
FIG. 7 is a perspective view of a portion of the latch assembly showing the latch in the engaged position.

As shown in FIG. 2, latch assembly 30 is mounted to the inner wall 16 of door 12 with fasteners, one of which is identified as 110. Referring to FIG. 6, latch assembly 30 includes a housing 112 with a flat plate 114 and a C-shaped plate 116 mounted to the flat plate 114. An L-shaped latch 118 and latch actuator 120 are positioned between flat plate 114 and C-shaped plate 116. Latch 118 includes an opening (not shown) that receives a portion of latch actuator 120 such that latch actuator 120 rotates with respect to latch 118. Latch actuator 120 includes an opening 122 that receives a portion of shaft 34 such that latch actuator 120 rotates with rotation of shaft 34 and handle 36. Latch actuator 120 includes ends 120*a* (FIG. 7) and 120*b* (FIG. 12) and sides 120*c* and 120*d*. Sides 120*c* and 120*d* include curved notches adjacent ends 120*a* and 120*b*. A pair of protrusions 124 and 126 extend outward from latch 118 and are positioned for engagement by the curved notches in the sides 120*c* and 120*d* of latch actuator 120. As shown in FIG. 6, C-shaped plate 116 includes a curved track 128 with notches 128*a* and 128*b* at its ends that serve as stops for protrusion 124, and a curved track 130 with notches 130*a* and 130*b* at its ends that serve as stops for protrusion 126.

Latch assembly 30 includes an eyebolt 132 with an eye 132*a* at one end that receives a protrusion 134 extending outward from latch 118. The opposite end of eyebolt 132 extends through a slot (not shown) in the bottom of C-shaped plate 116. A compression spring 136 encircles eyebolt 132 and extends from eye 132*a* to the bottom of C-shaped plate 116. As shown in FIG. 2, an upper bar 138 is joined to protrusion 124 and a lower bar 140 is joined to protrusion 126. As shown in FIG. 1, upper bar 138 is joined to an upper latch 142 and lower bar 140 is joined to a lower latch 144.

Referring to FIG. 1, emergency release 32 includes a push bar assembly 146 rotatably mounted to brackets 148 and 150, which are mounted to the inner wall 16 of door 12. As shown in FIG. 2, push bar assembly 146 includes a horizontal push bar 152 and a pair of triangular end brackets, one of which is identified as 154 in FIG. 2, each mounted to one end of the push bar 152. Triangular end bracket 154 includes a corner 154*a* joined to push bar 152, an opposite corner 154*b*, and a corner 154*c* positioned between corners 154*a* and 154*b*. Corner 154*c* is rotatably joined to bracket 150. A linkage assembly that connects push bar assembly 146 to latch assembly 30 includes a vertical bar 156 with one end joined to corner 154*b* and an opposite end joined to a flat bar 158 that is joined to protrusions 124 and 126.

Figure 11:
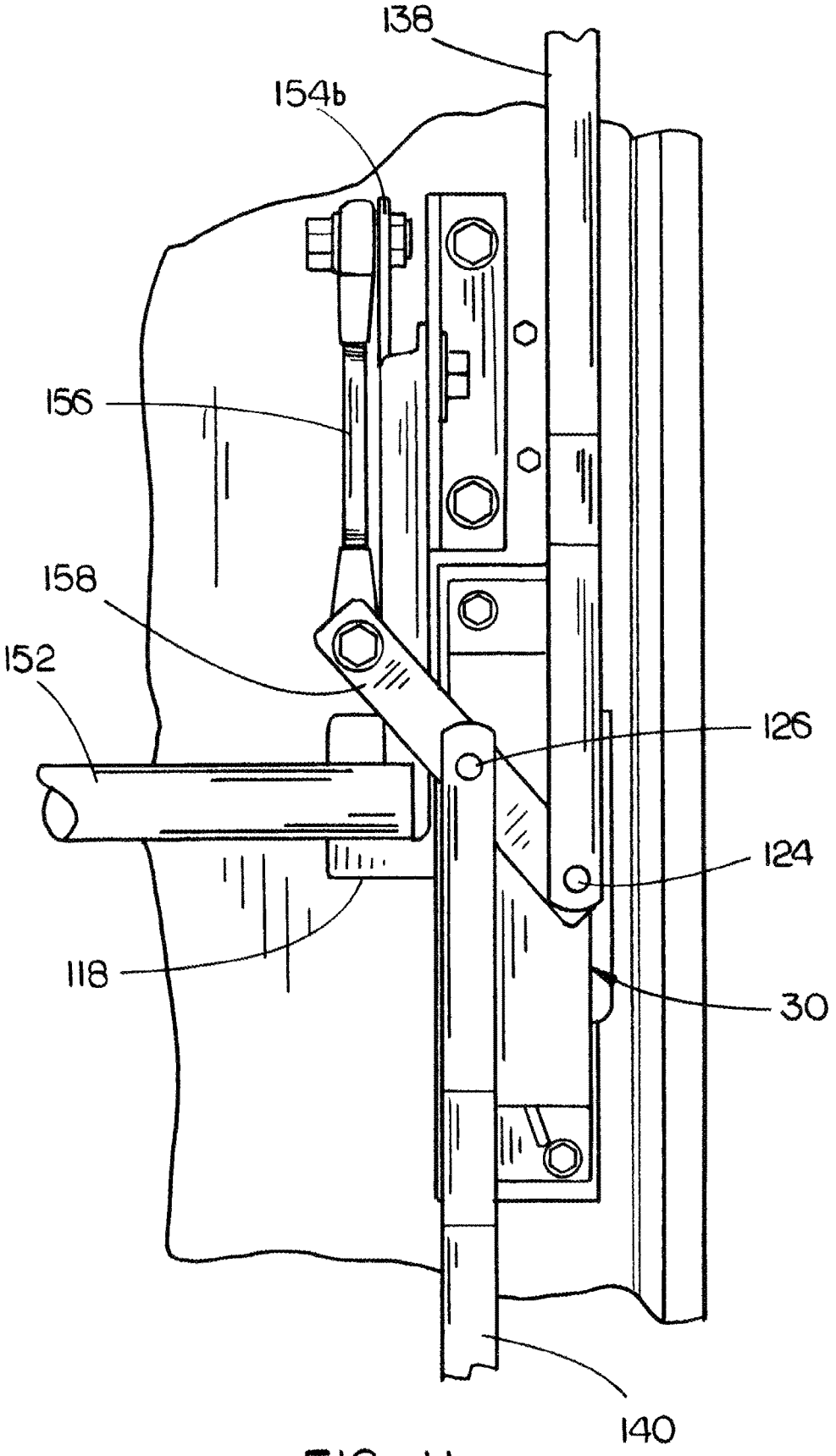
FIG. 11 is a close-up view of the latch assembly showing the latch in a disengaged position.

In operation, lock assembly 10 is operable to securely lock door 12 in place within a door frame (not shown) via actuation of latches 118, 142, and 144, shown in FIG. 1. Latches 118, 142, and 144 are moveable between an engaged position, shown in FIG. 1, in which door 12 is locked, and a disengaged position, shown in FIG. 11, in which door 12 is unlocked. The latches 118, 142, and 144 are moveable between the engaged and disengaged positions via rotation of handle 36, shown in FIG. 4.

Figure 12:
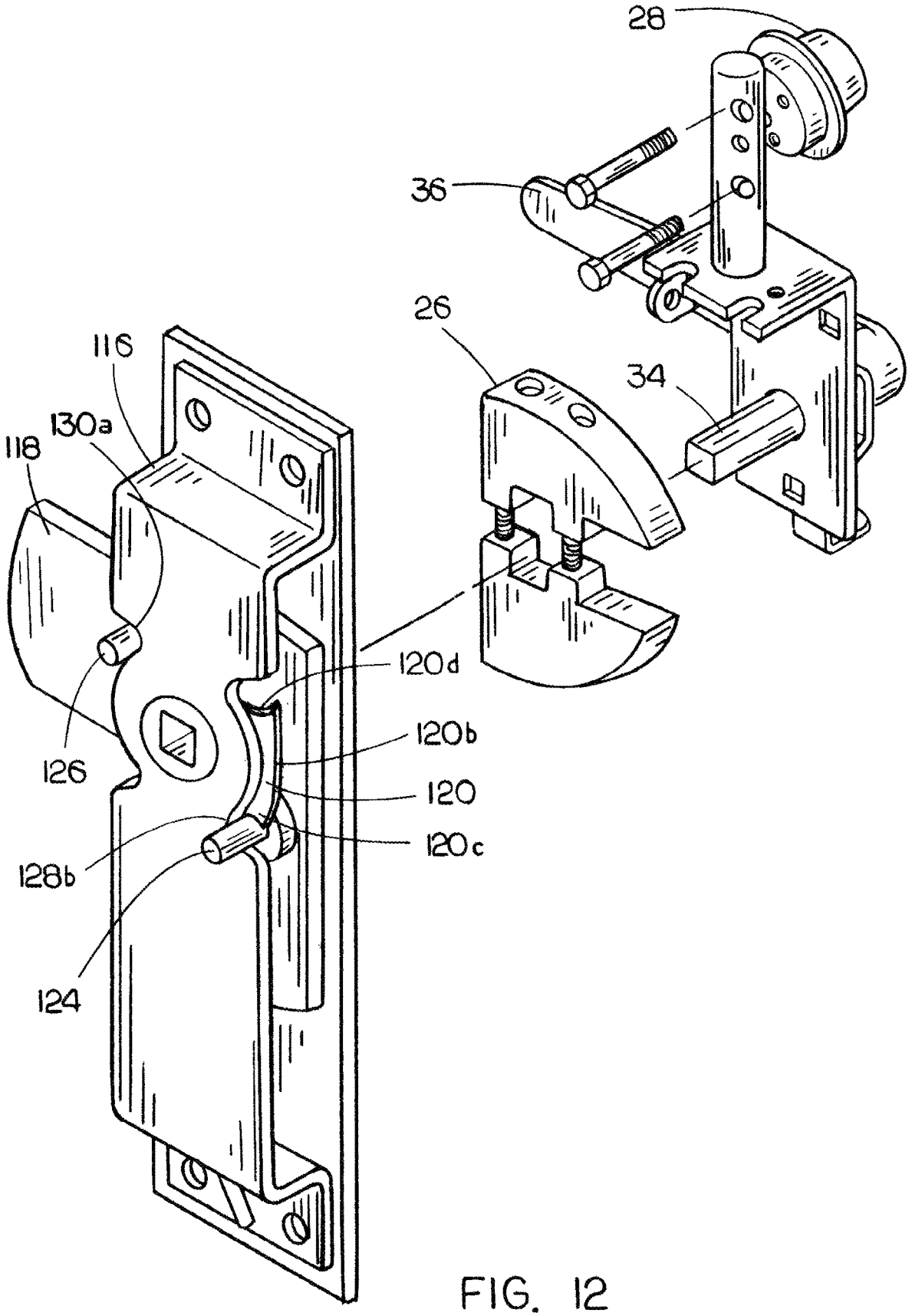
FIG. 12 is a partially exploded view of the actuator, the lock, the locking structure, and a portion of the latch assembly showing the latch in the disengaged position.

When bolt 108 of lock 28 is not received by receptacle 56 of locking structure 26, as shown in FIG. 9, handle 36 may be rotated from the neutral position shown in FIG. 4, in which the handle 36 is generally vertical, to a latch engaged position or a latch disengaged position. To move handle 36 from the neutral position to the latch disengaged position, handle 36 is rotated from the neutral position in a counterclockwise direction, when viewed as shown in FIG. 4, ninety degrees until the handle 36 is generally horizontal. FIG. 12 shows handle 36 in the latch disengaged position. To move handle 36 from the neutral position to the latch engaged position, handle 36 is rotated from the neutral position in a clockwise direction, when viewed as shown in FIG. 4, ninety degrees until the handle 36 is generally horizontal.

Latches 118, 142, and 144 are in the engaged position when handle 36 is in the latch engaged position, and latches 118, 142, and 144 are in the disengaged position when handle 36 is in the latch disengaged position. When latches 118, 142, and 144 are in the engaged position and lock 28 does not engage locking structure 26, handle 36 is freely moveable between the neutral position and the latch engaged position without moving latches 118, 142, and 144. When latches 118, 142, and 144 are in the disengaged position and lock 28 does not engage locking structure 26, handle 36 is freely moveable between the neutral position and the latch disengaged position without moving latches 118, 142, and 144.

When latches 118, 142, and 144 are in the engaged position, handle 36 may be rotated from the neutral position to the latch disengaged position to move the latches 118, 142, and 144 to the disengaged position. As handle 36 is rotated from the neutral position to the latch disengaged position, shaft 34 rotates latch actuator 120 from the position shown in FIG. 6 to the position shown in FIG. 12. As latch actuator 120 is rotated to the position shown in FIG. 12, sides 120*c* and 120*d* of latch actuator 120 engage protrusions 124 and 126, respectively, of latch 118 to rotate latch 118 from the engaged position to the disengaged position. When latch 118 is in the engaged position (FIG. 6), compression spring 136 is positioned to resist rotation of latch 118 to the disengaged position (FIG. 12). In order to rotate latch 118 from the engaged position to the disengaged position, handle 36 must be rotated with enough torque to compress spring 136 because as latch 118 rotates the distance between protrusion 134 and the bottom of C-shaped plate 116 decreases. When latch 118 is rotated to the disengaged position shown in FIG. 12, protrusions 124 and 126 engage notches 128*b* and 130*a*, respectively, of C-shaped plate 116 to prevent further rotation of latch 118.

Figure 3:
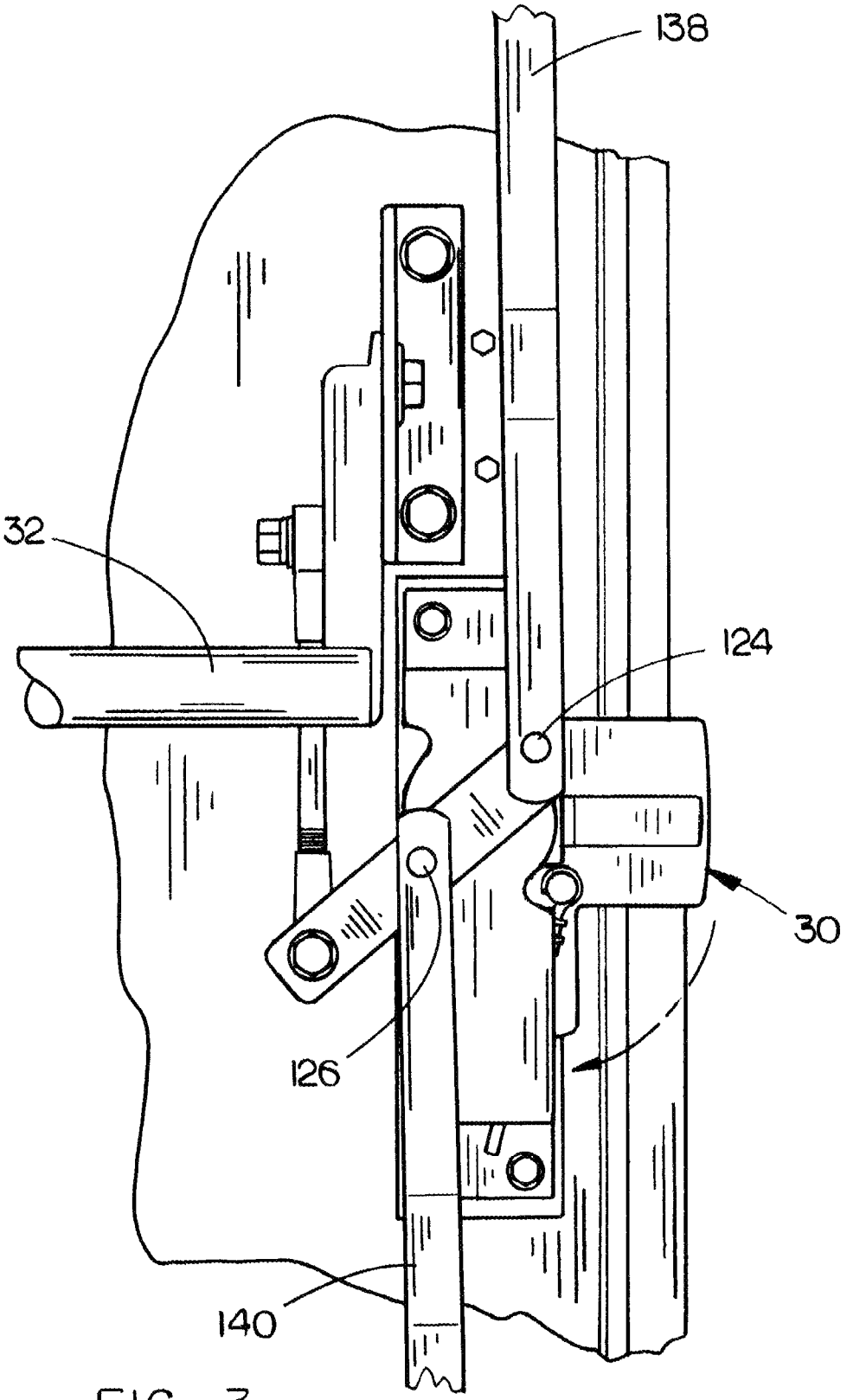
FIG. 3 is a close-up rear elevational view of the latch assembly showing a latch in an engaged position.

Rotation of latch 118 to the disengaged position also moves latches 142 and 144, shown in FIG. 1, to the disengaged position via upper and lower bars 138 and 140. As latch 118 moves to the disengaged position, protrusion 124 moves downward from the position shown in FIG. 3 to the position shown in FIG. 11, which causes upper bar 138 to move downward and latch 142 (FIG. 1) to move to the disengaged position. Further, as latch 118 moves to the disengaged position, protrusion 126 moves upward from the position shown in FIG. 3 to the position shown in FIG. 11, which causes lower bar 140 to move upward and latch 144 (FIG. 1) to move to the disengaged position. When latches 118, 142, and 144 are in the engaged position, they extend outward beyond the perimeter of door 12, and when they are in the disengaged position, they are retracted so that they do not extend beyond the perimeter of door 12.

When latches 118, 142, and 144 are in the disengaged position, handle 36 may be rotated from the neutral position to the latch engaged position to move the latches 118, 142, and 144 to the engaged position. As handle 36 is rotated from the neutral position to the latch engaged position, shaft 34 rotates latch actuator 120 to the position shown in FIG. 7. As latch actuator 120 is rotated to the position shown in FIG. 7, sides 120*c* and 120*d* of latch actuator 120 engage protrusions 124 and 126, respectively, of latch 118 to rotate latch 118 from the disengaged position to the engaged position. When latch 118 is in the disengaged position, compression spring 136 is positioned to resist rotation of latch 118 to the engaged position. In order to rotate latch 118 from the disengaged position to the engaged position, handle 36 must be rotated with enough torque to compress spring 136 because as latch 118 rotates the distance between protrusion 134 and the bottom of C-shaped plate 116 decreases. When latch 118 is rotated to the engaged position shown in FIG. 6, protrusions 124 and 126 engage notches 128*a* and 130*b*, respectively, of C-shaped plate 116 to prevent further rotation of latch 118.

Rotation of latch 118 to the engaged position also moves latches 142 and 144, shown in FIG. 1, to the engaged position via upper and lower bars 138 and 140. As latch 118 moves to the engaged position, protrusion 124 moves upward from the position shown in FIG. 11 to the position shown in FIG. 3, which causes upper bar 138 to move upward and latch 142 (FIG. 1) to move to the engaged position. Further, as latch 118 moves to the engaged position, protrusion 126 moves downward from the position shown in FIG. 11 to the position shown in FIG. 3, which causes lower bar 140 to move downward and latch 144 (FIG. 1) to move to the engaged position. As latches 118, 142, and 144 move from the disengaged position to the engaged position, they preferably engage a portion of the door frame (not shown) surrounding door 12 to pull door 12 in relatively tight sealing engagement with the frame in order to prevent moisture and contaminants from leaking between the door 12 and the frame. Door 12 is most preferably suitable for use with a NEMA Type 4 rated enclosure.

When latches 118, 142, and 144 are in the engaged position, handle 36 may be moved from the latch engaged position to the neutral position so that the receptacle 56 of locking structure 26 is positioned to receive bolt 108 of lock 28, as shown in FIG. 10. When lock 28 is actuated so that bolt 108 is received by receptacle 56, handle 36 may not be rotated to move latches 118, 142, and 144 from the engaged position to the disengaged position for the purpose of opening door 12 from the outside of the enclosure to which door 12 provides access.

However, even when lock 28 is actuated so that bolt 108 is received by receptacle 56, emergency release 32 (FIG. 1) may be operated to move latches 118, 142, and 144 from the engaged position to the disengaged position for the purpose of opening door 12 from the inside of the enclosure to which door 12 provides access so that a person is not accidentally locked inside the enclosure. Push bar 152, shown in FIG. 2, may be pushed toward door 12 to move latches 118, 142, and 144 from the engaged position to the disengaged position. As push bar 152 is pushed toward door 12, corner 154*b* and vertical bar 156 raise upward from the position shown in FIG. 2 to the position shown in FIG. 11. Upward movement of vertical bar 156 causes flat bar 158 to rotate from the position shown in FIG. 2 to the position shown in FIG. 11, which causes protrusion 124 to move downward to the position shown in FIG. 11 and protrusion 126 to move upward to the position shown in FIG. 11. When protrusions 124 and 126 are in the position shown in FIG. 11, latches 118, 142, and 144 are in the disengaged position, as described above.

When handle 36 is locked in the neutral position via lock 28 and locking structure 26, emergency release 32 may move latches 118, 142, and 144 from their engaged position to their disengaged position independently from handle 36 because latch 118 is rotatable independently from handle 36 when handle 36 is in the neutral position. As shown in FIG. 6, when handle 36 is in the neutral position and latch 118 is in the engaged position, latch actuator 120 does not prevent rotation of latch 118 to the disengaged position so that emergency release 32 may move latches 118, 142, and 144 to the disengaged position. Because handle 36 cannot be locked in the latch engaged position via locking structure 26 and lock 28, emergency release 32 may move latch actuator 120 and handle 36 to the neutral position when moving latches 118, 142, and 144 from the engaged position to the disengaged position.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A lock assembly, comprising:

an actuator moveable between first, second, and third positions, wherein the actuator moves from the first position to the second position in a first direction, and the actuator moves from the first position to the third position in a second direction that is opposite the first direction;

a locking structure coupled to the actuator and comprising a receptacle positioned to receive at least a portion of a lock when the actuator is in the first position to prevent movement of the actuator; and a latch assembly coupled to the actuator, wherein the latch assembly comprises at least one latch that is moveable by the actuator between an engaged position and a disengaged position.

2. The lock assembly of claim 1, wherein the receptacle is not positioned to receive the portion of the lock when the actuator is in the second position.

3. The lock assembly of claim 1, wherein the actuator comprises a shaft that is rotatable between the first and second positions, and wherein the actuator comprises a handle coupled with the shaft.

4. The lock assembly of claim 1, wherein the lock comprises a lock protrusion, wherein the lock protrusion moves between an unlocked position and a locked position, in which the lock protrusion is received by the receptacle when the actuator is in the first position.

5. The lock assembly of claim 4, wherein the actuator extends through an opening in a door having an exterior side and an interior side, and wherein the locking structure and lock protrusion are positioned adjacent the interior side.

6. The lock assembly of claim 5, wherein the lock comprises a user input device positioned adjacent the exterior side of the door.

7. The lock assembly of claim 4, wherein the lock protrusion moves vertically downward from its unlocked position to its locked position.

8. The lock assembly of claim 1, wherein the lock is separate from the actuator and the locking structure.

9. The lock assembly of claim 1, wherein the latch assembly is in the engaged position when the actuator is in the second position, and wherein the latch assembly is in the disengaged position when the actuator is in the third position.

10. The lock assembly of claim 9, wherein when the latch assembly is in the engaged position, the actuator is moveable between the first and second positions, and when the latch assembly is in the disengaged position, the actuator is moveable between the first and third positions.

11. The lock assembly of claim 1, further comprising an emergency release coupled to the latch assembly, wherein the emergency release is operable to move the latch assembly from the engaged position to the disengaged position when the actuator is in the first position.

12. The lock assembly of claim 1, wherein the latch assembly comprises three latches that are each moveable between an engaged position and a disengaged position.

13. An assembly, comprising:

an actuator moveable between first, second and third positions;

a latch assembly coupled to the actuator, wherein the latch assembly comprises at least one latch that is moveable between an engaged position and a disengaged position, wherein the latch assembly is in the engaged position when the actuator is in the second position, wherein the latch assembly is in the disengaged position when the actuator is in the third position, wherein when the latch assembly is in the engaged position, the actuator is moveable between the first and second positions, and when the latch assembly is in the disengaged position, the actuator is moveable between the first and third positions; and a locking structure coupled to the actuator, wherein the locking structure is positioned to engage a portion of a lock when the actuator is in the first position to prevent movement of the actuator to the second position or the third position.

14. The assembly of claim 13, wherein the lock comprises a lock protrusion, wherein the lock protrusion moves between an unlocked position and a locked position, and wherein the locking structure comprises a receptacle that is positioned to receive the lock protrusion when the actuator is in the first position and the lock protrusion is in the locked position.

15. The assembly of claim 13, further comprising an emergency release coupled to the latch assembly, wherein the emergency release is operable to move the latch assembly from the engaged position to the disengaged position when the actuator is in the first position.

16. The assembly of claim 13, wherein the actuator comprises a shaft that is rotatable between the first, second and third positions, and wherein the actuator comprises a handle coupled to the shaft.

17. The assembly of claim 13, wherein the actuator moves from the first position to the second position in a first direction, and the actuator moves from the first position to the third position in a second direction that is opposite the first direction.

18. An assembly, comprising:

an actuator moveable between first, second, and third positions, wherein the actuator moves from the first position to the second position in a first direction, and the actuator moves from the first position to the third position in a second direction that is opposite the first direction;

a locking structure coupled to the actuator and comprising a receptacle positioned to receive at least a portion of a lock when the actuator is in the first position to prevent movement of the actuator;

a latch assembly coupled to the actuator, wherein the latch assembly comprises at least one latch that is moveable by the actuator between an engaged position and a disengaged position; and an emergency release coupled to the latch assembly, wherein the emergency release is operable to move the latch assembly from the engaged position to the disengaged position independently from the actuator when the actuator is in the first position and movement of the actuator is prevented by the locking structure.

19. The assembly of claim 18, wherein the latch assembly is in the engaged position when the actuator is in the second position, and wherein the latch assembly is in the disengaged position when the actuator is in the third position.

20. The assembly of claim 19, wherein when the latch assembly is in the engaged position, the actuator is moveable between the first and second positions, and when the latch assembly is in the disengaged position, the actuator is moveable between the first and third positions.

21. The assembly of claim 18, wherein the lock comprises a lock protrusion, wherein the lock protrusion moves between an unlocked position and a locked position, in which the lock protrusion is received by the receptacle when the actuator is in the first position.

22. The assembly of claim 21, wherein the actuator extends through an opening in a door having an exterior side and an interior side, and wherein the locking structure, lock protrusion, and emergency release are positioned adjacent the interior side.

* * * * *